US005427523A

United States Patent [19]

Yiu

[11] Patent Number: 5,427,523

[45] Date of Patent: Jun. 27, 1995

[54] SAFETY LIGHTER HAVING LEVER ARRESTED DEFAULT STATE

[75] Inventor: Chung L. Yiu, Kowloon, Hong Kong

[73] Assignee: Harbour Union Limited, Hong Kong

[21] Appl. No.: 200,954

[22] Filed: Feb. 24, 1994

[51] Int. Cl.[6] ..... F23D 11/36

[52] U.S. Cl. ..... 431/153; 431/277

[58] Field of Search ..... 431/277, 153, 256

[56] References Cited

U.S. PATENT DOCUMENTS

| | | | |
|---|---|---|---|
| Re. 33,282 | 7/1990 | Schächter | 431/344 |
| D. 247,316 | 2/1978 | Beeson et al. | D27/39 |
| 3,547,566 | 12/1970 | Tamarin | 431/88 |
| 3,899,286 | 8/1975 | Lockwood et al. | 431/321 |
| 4,036,579 | 7/1977 | Marynissen | 431/131 |
| 4,039,088 | 8/1977 | Marynissen | 214/1 |
| 4,133,450 | 1/1979 | Beeson et al. | 220/411 |
| 4,496,309 | 1/1985 | Schäter | 431/344 |
| 4,509,916 | 4/1985 | Leboudec | 431/273 |
| 4,560,345 | 12/1985 | Schächter | 431/344 |
| 4,717,335 | 1/1988 | Loveless | 431/277 |
| 4,758,152 | 7/1988 | Kordecki | 431/153 |
| 4,830,603 | 5/1989 | Cirami | 431/153 |
| 4,832,596 | 5/1989 | Morris | 431/153 |
| 4,884,964 | 2/1989 | Nitta | 431/277 |
| 5,002,482 | 3/1991 | Fairbanks | 431/277 |
| 5,085,578 | 2/1992 | Hunter | 431/277 |
| 5,092,764 | 3/1992 | McDonough | 431/277 |
| 5,125,829 | 6/1992 | McDonough | 431/255 |
| 5,165,885 | 11/1992 | Iwahori | 431/153 |
| 5,197,870 | 3/1993 | Yang | 431/153 |
| 5,213,495 | 5/1993 | Pan | 431/153 X |
| 5,215,458 | 6/1993 | Cirami | 431/277 |
| 5,262,697 | 11/1993 | Meury | 310/339 |
| 5,271,731 | 12/1993 | Hsin-Chung | 431/277 X |

*Primary Examiner*—Carl D. Price

*Attorney, Agent, or Firm*—Beveridge, DeGrandi, Weilacher & Young

[57] ABSTRACT

A lighter is described which includes a fuel compartment and a flame generating portion attached to the fuel compartment. The flame generating portion includes at least one catch tab and at least one fuel lever stopping device. Catch tabs may be provided on rails which are mounted on a surface of the flame generating portion, or they may be provided as inwardly folded flanges on a cap. A special fuel lever is provided in accordance with the invention to allow the release of fuel. The fuel lever includes flanges which engages with the catch tab of the flame generating portion. A finger pad disposed at one end of the fuel lever includes a notch which engages with the stopping device of the fuel generating portion. The lighter is movable between a default position and a pre-actuation position. In the default position, the stopping device is arranged to engage the finger pad at a position away from the notch. In the pre-actuation position, the stopping device is arranged adjacent the notch in the finger pad such that when the fuel lever is depressed, the stopping device is received in the notch. In a second embodiment of the invention, the fuel lever includes a side wheel arresting device that extends from a surface of a prong on the fuel lever. The side wheel arresting device is arranged to prevent the flintwheel from rotating when the lighter is in the default position, thereby preventing sparking.

19 Claims, 4 Drawing Sheets

F

SAFETY LIGHTER HAVING LEVER ARRESTED DEFAULT STATE

BACKGROUND OF THE INVENTION

The present invention relates to a child resistant disposable lighter and in particular, to a disposable lighter which, in a locked default state, has its fuel delivery lever arrested by a lever stopping device that prevents depression of the lever. This lever stopping device renders the lighter difficult to operate by young children.

Pursuant to Consumer Product Safety Commission (CPSC) inquiries into the safety of present day disposable lighters, and the likelihood of rule making mandating that the design of disposable lighters be child resistant, the present invention pertains to a child resistant disposable lighter.

As is well known in the art, a typical disposable lighter includes a compartment portion containing a fuel such as butane, and an upper portion. The upper portion contains an arrangement wherein a flint is in contact with the bottom of a flintwheel, and a valve means delivers fuel in response to being actuated by a lever mounted in a fulcrum arrangement such that depressing the lever actuates the valve to deliver fuel. The valve opening is located proximately toward the front of the flintwheel/flint arrangement, and the fuel delivery lever is located proximately behind the flintwheel. The arrangement is designed such that the lighter can be grasped between the fingers, wherein the thumb is used to rotate the flintwheel backward toward the lever thus generating sparks from the flint/flintwheel interface in the direction of the valve opening. Essentially instantaneously after the thumb rolls off the flintwheel, it depresses the fuel lever to release fuel. The fuel is exposed to the sparks and ignited to thereby produce a flame.

The simplicity of the state of the art design renders it easily operated by young children who may encounter the lighter. Many fires and injuries have been caused by young children setting fires with such lighters. Fires started in such a manner are frequent, and thus, the CPSC has considered mandating that these lighters be child-resistant.

Several designs for child-resistant lighters are known. For example, U.S. Pat. No. 4,830,603 to Cirami relates to a cigarette lighter in which a locking mechanism is provided partially under a valve-actuating pushbutton and extends into a compartment appended to, but distinct from, a fuel compartment. This Cirami patent is entirely incorporated herein by reference. The locking mechanism in the Cirami device relocks itself after each depression of the pushbutton. In particular, one end of a stiffly flexible, spring steel wire is held firmly in place in the compartment. Another end of the spring steel wire forms a probe extending into a channel provided in the underside of the pushbutton. The spring steel wire, in a locked configuration, prevents depression of the pushbutton by engaging a low ceiling on the underside of the pushbutton. A portion of the spring steel wire in the form of a loop extending outward from the lighter is accessible by an operator and may be suitably moved by the operator thereby causing the probe to move within the channel in the underside of the pushbutton.

U.S. Pat. No. 4,832,596 to Morris, Sr. (also entirely incorporated herein by reference) relates to a cigarette lighter having a stop member slidably mounted thereon for releasably engaging a gas valve actuating lever. In particular, a spring biased stop member is slidably mounted on a top portion of a conventional portable disposable cigarette lighter. The stop member is biased so as to place one of its ends under the lighter's gas valve actuating lever so as to prevent movement of the lever in a direction which may open the gas valve. The lever may be actuated once the stop member is pushed in a direction opposite to the biasing force of the spring so as to slide the end which is under the lighter's gas valve outward.

U.S. Pat. No. 4,717,335 to Loveless (also entirely incorporated herein by reference) relates to a cigarette lighter in which rotation of a spark-producing wheel is limited. In particular, the spark-producing wheel may be rotated in one direction to deliver a spark toward a nozzle through which gaseous fuel is passed, thereby operating the lighter and causing fuel to ignite. Rotation of the spark-producing wheel in the other direction may deliver a spark away from the nozzle. The spark-producing wheel has a pin-shaped structure attached thereto which serves to limit the rotation of the wheel to under 360 by contacting the housing structure. Thus, whether a spark is produced depends upon the direction of attempted rotation and the position of the pin-shaped structure relative to the housing structure. In theory, once the lighter is operated and the fuel ignited, and the pin-shaped structure has traversed its entire path of travel, subsequent operation of the lighter is impeded since the pin-shaped structure comes into contact with the housing, preventing a spark from occurring in the vicinity of the fuel nozzle.

U.S. Pat. No. 3,547,566 to Tamarin and U.S. Pat. No. 3,899,286 to Lockwood relate to lighters having orientation sensing mechanisms which hinder or prevent actuation of the lighter in an inverted position. Unfortunately such mechanisms may not provide a sufficient degree of safety to young children who tamper with the lighter, because they merely hinder operation in prescribed orientations. The Tamarin and Lockwood patents are entirely incorporated herein by reference.

Kordecki, U.S. Pat. No. 4,758,152, McDonough, U.S. Pat. No. 5,092,764, and Cirami, U.S. Pat. No. 5,215,458 all show safety mechanisms used in connection with lighters. These documents also are entirely incorporated herein by reference.

Many of the aforedescribed safety mechanisms and others like them suffer from a number of limitations. Some of these designs are unnecessarily complicated, rendering them difficult to manufacture and subject to mechanical failure with use. Lighters, like the one described in U.S. Pat. No. 4,830,603 to Cirami, impose limits on the useful fuel compartment space by incorporating portions of the safety mechanism into that area of the lighter. In particular, Cirami describes using more than half of the fuel compartment to secure a spring which prevents the fuel delivery lever from being depressed. Such a design would shorten the useful life of the lighter because the fuel capacity is significantly diminished.

Other safety designs fail to conform to present day lighter configurations and often resort to substantially reconfiguring the lighter, or utilizing useful space in a conventional configuration, as in the Cirami design. Some child resistant disposable lighter designs render the lighter too unwieldy to be operated easily. Such lighters may require the operator to turn the lighter in their hand in order to disable the safety mechanism and then to return the lighter to its operating position before use.

Another disadvantage present in previous designs is the ease with which the safety mechanisms can be defeated, thus limiting the design's utility in preventing its use by young children. Such is the case in designs which, in addition to the conventional components, such as the flintwheel and fuel lever, also have an additional lever or knob associated with the safety mechanism, which must be actuated in order to operate the lighter. Such additional features invite experimentation from curious youngsters which could ultimately lead to the defeat of the safety feature. Another important feature is a child resistant lighter's ability to return to a default safety state so that even if the safety feature is defeated once, the lighter will automatically reset the safety mechanism after an attempt is made to operate the lighter after the safety is defeated.

It is an object of the present invention to provide a lighter which is child resistant having a default safety state wherein the safety mechanism is reset after each attempted use. It is a further object of the present invention to provide a child resistant lighter design which is minimally complicated from a manufacturing standpoint wherein the lighter does not have to be substantially altered from a conventional configuration to incorporate the safety feature. It is another object of the invention to provide a child resistant lighter which adopts a simple design which makes the lighter rigorous and long lasting. It is yet another object of the invention to provide a child resistant lighter which does not utilize useful space, such as the fuel compartment, to incorporate the safety mechanism into the existing design configuration. It is still a further objective to provide a child resistant lighter whose safety mechanism is not easily defeated and does not invite curiosity or experimentation. It is an additional objective to provide a lighter whose safety mechanism can be deactivated while the lighter is in a normal operating position.

SUMMARY OF THE INVENTION

The foregoing objects are achieved in a lighter according to the present invention wherein a disposable lighter design is provided with a child-resistant safety mechanism. The disposable lighter is provided with a lower fuel compartment containing a fuel such as butane; an intermediate portion which forms the sealing means for the fuel compartment and through which a wicking means communicating between a fuel valve and the fuel compartment passes; and an upper portion, secured to the intermediate portion, which houses a flint that is urged against a flintwheel, a fuel release lever, and an upper portion of a fuel valve having a valve opening. The exposed rear portion of the fuel lever, which is located just behind the flintwheel, is coupled with the upper portion of the fuel valve in a fulcrum mount arrangement. The valve opening is located just in front of the flintwheel. The fuel lever communicates with the fuel valve in the fulcrum mount arrangement such that depressing the fuel lever will lift the valve and allow fuel to flow from the valve opening. Typically, the upper portion of the valve, part of the flintwheel, and the portion of the fuel lever connected to the valve, are enclosed by a cap means with an upper opening for the flame produced by the lighter.

The lighter of the present invention includes a fuel lever arrangement which has been adapted to prevent depression of the fuel lever in a default, locked position. In this position, the undersurface of the exposed rear portion of the fuel lever rests against a stop means which projects upward from a surface below the exposed portion of the lever. A portion of the undersurface of the exposed rear portion of the fuel lever has a notch means formed in it which is adapted to receive the stop means. A lever spring urges the fuel lever rearward and upward, into a default position wherein the stop means is maintained abutting the undersurface of the lever at a position in front of the notch means.

The fuel lever also has flanges projecting laterally outward from the lever. At least one catch tab projecting from the surface of the upper portion of the lighter is arranged in a spaced relationship with a flange. Alternatively, the catch tabs may be provided on rails which are arranged on the surface of the upper portion of the lighter. The inventive design provides for a slidable lever mount which is adapted to allow the fuel lever to be pushed slightly forward toward the front of the lighter along the longitudinal axis of the fuel lever, compressing the lever spring, so that the flange engages with, and is secured by the catch tab, placing the lighter in an operable state. In such a position, the fuel lever is restrained from sliding backward and upward, but it may be depressed.

In this operable state, the notch means on the undersurface of the fuel lever is substantially aligned with the stop means therebelow. In such a state, the lighter can be operated in a conventional fashion as follows: the lighter is held in a hand with the fuel lever, or the rear portion of the lighter, facing toward the thumb; the thumb is pressed against the flintwheel and rotates it toward the exposed portion of the lever to produce a spark in front of the flintwheel. The thumb strikes the fuel lever immediately after rolling off the flintwheel. As the thumb rolls off the flintwheel, almost instantaneously the fuel lever is depressed to its fuel releasing extent, wherein the lever stop means is received by the notch means in the undersurface of the fuel lever, before the fuel lever spring can expand and push the fuel lever back to its default, locked position. In pushing the fuel lever down to its fuel releasing extent, fuel is released from the valve opening, exposed to the spark, and ignited, thus producing a flame. In pushing the fuel lever down to its fuel releasing extent, the flange is disengaged from the catch tab, releasing the fuel lever and allowing it to slide rearward. After the operator's thumb is lifted off the fuel lever, the lever spring urges the lever rearward and upward, restoring the lever to its default, safety position.

The flange may project sideways, or inward in the case where the fuel lever is a two pronged fork-type structure. The catch tab would, of course, be appropriately arranged to contact with and secure the flange when the fuel lever is moved.

In an additional embodiment of the lighter in accordance with the invention, the fuel lever would include a flintwheel arrest means which would project upward from the fuel lever and engage the flintwheel when the lighter is in the default locked state, thereby preventing the flint wheel from being rotated, and thus preventing a spark from being generated.

BRIEF DESCRIPTION OF THE DRAWINGS

These and other advantageous features of the invention will become apparent to those skilled in the art from the following detailed description of the invention, particularly when viewed in combination with the attached drawings, wherein.

DETAILED DESCRIPTION OF THE PREFERRED EMBODIMENTS

Figure 1:
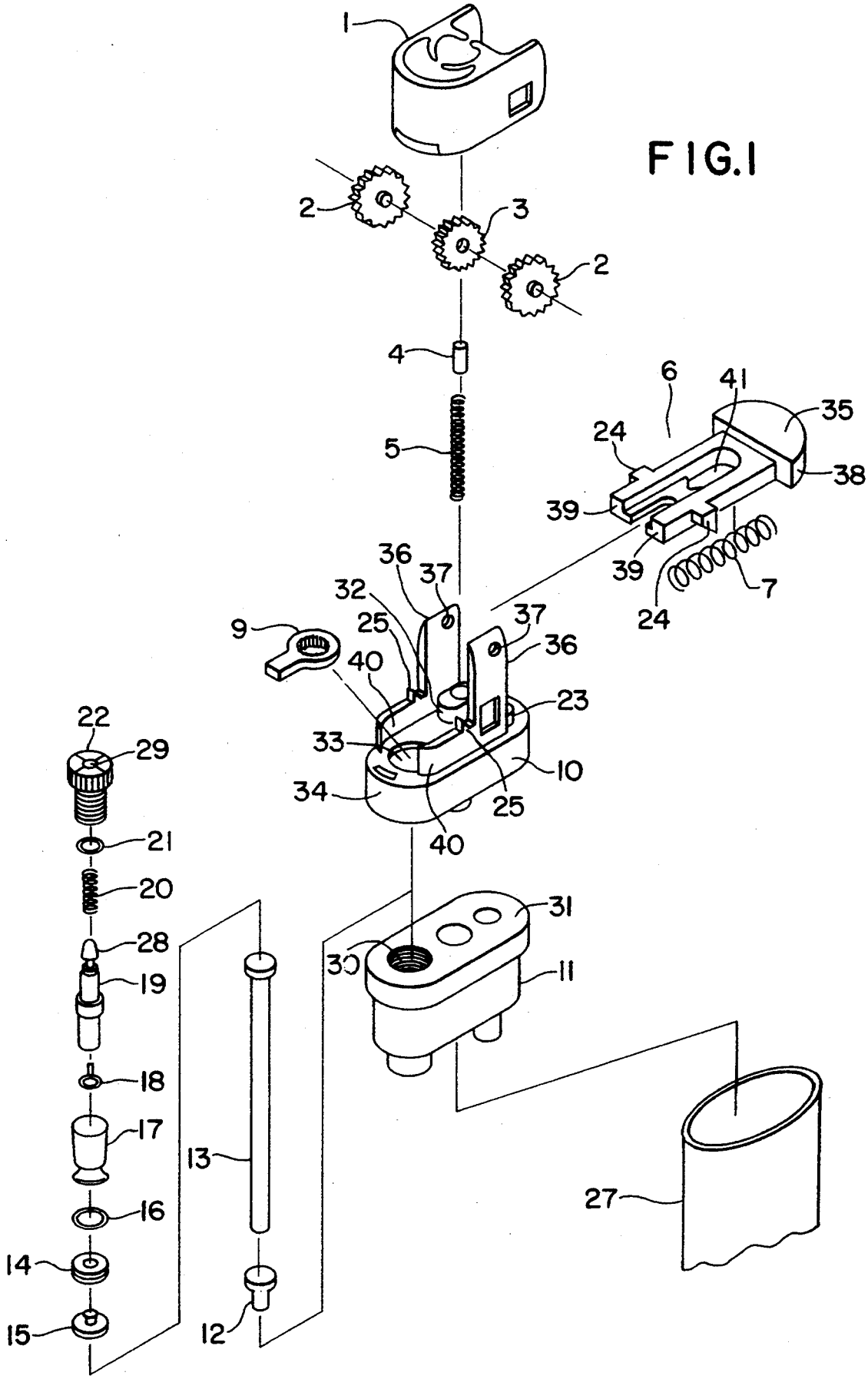
FIG. 1 shows an exploded view of a child resistant lighter according to the present invention.

The invention is described in detail with respect to FIG. 1. The disposable child-resistant lighter in accordance with the invention includes a lower fuel containing compartment 27 which has an open upper part that is adapted to receive and be sealed by an intermediate lighter portion 11. The intermediate lighter portion 11 receives an actuatable valve means 19 which has an upper portion 28 extending vertically upward through a front area 30 of the intermediate portion 11. The front area 30 of the intermediate portion 11 holds a screw 22 which receives the upper portion 28 of the valve means 19 through a small O-ring 21 and a valve spring 20 arrangement. The upper portion 28 of the valve means 19 extends through a valve opening 29 in the screw 22.

The valve means 19 includes a lower portion packed into a valve bottom portion 17, including a T-packing 18. The valve bottom portion 17 is connected to a filter 14 and a filter plate assembly 15 via a relatively large O-ring 16. A wick 13 connects to the filter plate 15 and extends away from the intermediate portion 11 to a wick holder 12 and into fuel contained in the fuel compartment 27. An upper lighter portion 10 is seated on an upper surface 31 of the intermediate portion 11. An adjustment ring 9 is provided with the upper portion 10 in the area of the upper portion of the screw 22 to control the flame height. The valve means 19 operates in a conventional manner known to those skilled in the art.

A fuel lever 6 moves in a fulcrum arrangement about a flint mount 32 which is located on the upper surface 34 of the upper lighter portion 10. The fuel lever 6 has a front end corresponding to the front end 33 of the upper lighter portion. 10, and a rear end which includes a finger pad portion 35. The front end of the fuel lever 6 has a two prong fork configuration 39 wherein the upper portion 28 of the actuatable valve 19 is disposed between and engaged by the prongs 39.

When the finger pad 35 is depressed and the fuel lever 6 pushed to its fuel release extent, the front portion of the fuel lever 6 is raised thereby lifting the upper portion 28 of the valve 19 and releasing fuel from the fuel compartment 27.

Two opposing substantially vertical flanges 36 and two rails 40 extend from peripheral portions at the middle area of the upper surface 34 of the upper lighter portion 10. The flanges 36 have inner mounting means 37 adapted to receive and secure an axle of a flintwheel arrangement mounted between the substantially vertically extending flanges 36. The flintwheel arrangement includes a file or flintwheel 3 mounted between two side wheels 2. The upper surface 34 of the upper lighter portion 10 also includes the flint mount 32 located between the flanges 36. Flint mount 32 secures one end of a flint spring 5, and the other end of the flint spring-5 urges a flint 4 mounted therein against the flintwheel 3. Portions of this upper surface 34 of the upper lighter portion 10 and the flint arrangement are covered by a cap 1. The upper lighter portion 10, the intermediate lighter portion 11 and the cap 1 form a flame generating portion of the lighter.

The upper surface 34 of the upper lighter portion 10 also has a pair of catch tabs 25 mounted thereon located just in front of the substantially vertically extending flanges 36. The catch tabs 25 are preferably provided on rails 40 which are disposed on the upper surface 34 of the upper lighter portion 10. Each catch tab 25 preferably has a substantially vertical front wall perpendicular to the upper surface 34 of the upper lighter portion 10, and a bevelled rear wall. The catch tabs 25 and/or the side flanges 24 may act as the fulcrum for the fuel lever 6.

A lever stop means 23 is included on the upper surface 34 of the upper lighter portion 10. The lever stop means 23 extends substantially vertically upward from the rear area of the upper surface 34 of the upper lighter portion 10. The lever stop means 23 is preferably a peg or short rail which extends upward from the upper lighter portion 10.

On the undersurface of the fuel lever 6, below the finger pad 35, a notch 38 is formed which is shaped to receive the lever stop means 23. The fuel lever 6 includes a pair of side flanges 24 which extend substantially perpendicular from the side surfaces of the fuel lever 6. Each side flange 24 has a substantially vertical rear wall and a bevelled frontal wall, wherein the bevelled frontal wall slopes from the frontal upper surface of the fuel lever 6 toward the rear bottom surface of the fuel lever 6.

The bottom surface of the fuel lever 6 has a partial central channel 41 extending from the middle portion of the fuel lever 6 toward the finger pad 35. This central channel 41 partially receives a lever spring 7 whose other end abuts the flint mount 32. The fuel lever 6 is slidably mounted in a fulcrum arrangement wherein the fuel lever 6 is adapted to partially slide in a front and rear direction along its longitudinal axis with the side flanges 24 riding along the rails 40 and along the bevelled rear wall of the catch tabs 25. The two prongs 39 of the fork like portion slide so as to maintain their engagement with the upper portion 28 proximate the valve 19.

In its default, locked, safety state, the lever stop 23 abuts or is located immediately adjacent the undersurface of the fuel lever 6 just ahead of the notch 38 in the undersurface of the finger pad 35. This arrangement prevents the fuel lever 6 from being depressed to its fuel releasing extent. Because the fuel lever 6 cannot be depressed to its fuel releasing extent, the valve 19 cannot be raised, and thus fuel cannot be released. Therefore, in its default state the lighter can not be lit.

Figure 2A:
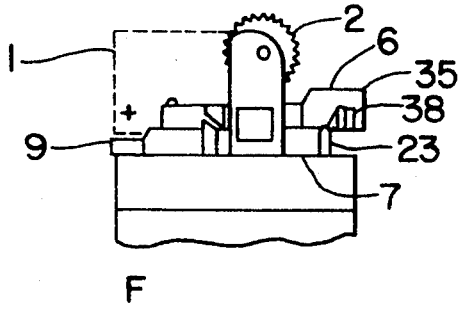
FIGS. 2A, 2B and 2C show the operative steps involved in using the child resistant lighter according to the present invention.
Figure 2B:
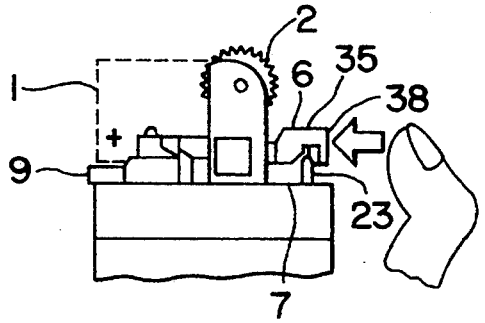
Figure 2C:
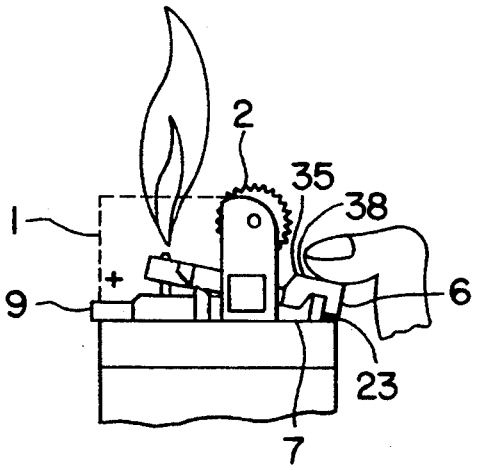

The process for lighting the lighter is illustrated in FIGS. 2A through 2C. This process involves pushing the fuel lever 6 into a pre-actuation position. FIG. 2A shows the lighter in its default, locked position. As shown, the fuel lever 6 is positioned such that the lever stop means 23 contacts (or is located immediately adjacent) to the undersurface of the finger pad 35 just in front of the notch 38. The fuel lever 6 is biased into this position by the force of the lever spring 7. In this position, the fuel lever 6 cannot be depressed to its fuel releasing extent because of the close relationship between the stop means 23 and the undersurface of the finger pad 35.

The fuel lever 6 may be moved to its pre-actuation position as shown in FIG. 2B. This is done by manually pushing the fuel lever 6 in a forward direction along a longitudinal axis of the fuel lever 6, thereby compressing the lever spring 7. When the fuel lever is pushed in this manner, the bevelled portion of the side flanges 24 slide up and over the bevelled portion of the catch tab 25 so that the substantially vertical walls of the catch tabs 25 engage and abut the substantially vertical walls of the side flanges 24. The substantially vertical walls of the side flanges 24 and the substantially vertical walls of the catch tabs 25 are held engaged to one another by the lever spring 7, thereby securing the lever 6 in the pre-actuation position. In this position, as shown in FIG. 2B, the notch 38 in the undersurface of the finger pad 35 is substantially aligned over the lever stops 23. Therefore, when the lighter is operated in a conventional manner, as shown in FIG. 2C, and when the operator's thumb strikes the finger pad 35 nearly instantaneously after rolling off the sidewheel 2, the fuel lever 6 is depressed to its fuel releasing extent wherein the lever stop 23 is received by the notch 38 and fuel is released from the valve 19.

Depressing the fuel lever 6 to its fuel releasing extent also has the effect of causing the side flanges 24 to uncouple from the catch tabs 25 so that the substantially vertical walls of the side flanges 24 and the substantially vertical walls of the catch tabs 25 slide relative to one another and disengage. After the operator's thumb is released from the finger pad 35, the lever spring 7 urges the fuel lever 6 rearward and upward to restore the fuel lever 6 to its default, locked position wherein the lever stops 23 are once again adjacent the undersurface of the finger pad 35 just ahead of the notch 38 (i.e., back to the position shown in FIG. 2A). Thus, the lighter is automatically restored to its default, locked state.

Figure 3:
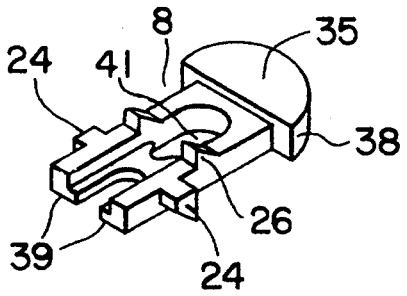
FIG. 3 shows a second embodiment of the fuel lever of the present invention.

In a second embodiment, shown in FIG. 3, the fuel lever 8 has flintwheel arrest means 26 projecting upward from the prongs 39 at a position in front of the finger pad 35. Each flintwheel arrest means 26 includes an inclined wall which engages the teeth of the sidewheel 2 in the flintwheel arrangement when the fuel lever 8 is in the default, locked position. In doing so, the sidewheel 2 and the flintwheel 3 are prevented from rotating. Thus, in this embodiment, not only is fuel prevented from being released, but the flintwheel arrangement also is prevented from being rotated. Thus, no sparks can be produced. It is apparent that the fuel lever 8 in the embodiment shown in FIG. 3 may be readily substituted for the fuel lever 6 shown in the embodiment illustrated in FIG. 1.

Figure 4:
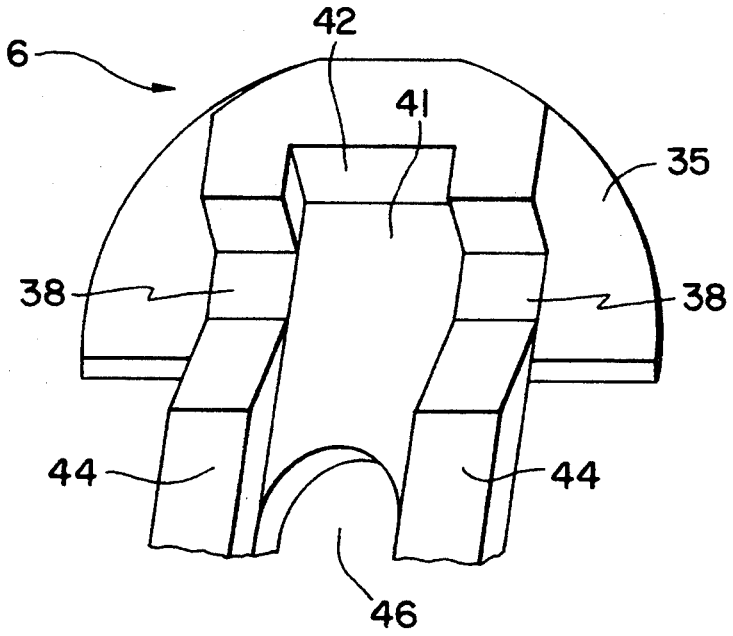
FIG. 4 shows the underside of the notch area in an embodiment of the fuel lever in accordance with the invention.

One embodiment of the undersurface of the finger pad 35 portion of the fuel lever 6 is shown in FIG. 4. As shown, the notch 38 is machined into the undersurface of the finger pad 35 toward the rear end of the fuel lever 6. The central channel area 41 is provided in this undersurface such that the lever spring 7 (not shown in FIG. 4) is received and abuts against the back wall 42 of the central channel 41. In the default, locked position, the lever stop means 23 (i.e., pegs or rails; not shown in FIG. 4) is positioned such that it will abut or be adjacent raised ledges 44. In the pre-actuation position, the fuel lever 6 is slid forward such that the stop means 23 will be received in the notch portion 38 when the fuel lever 6 is depressed. The flint mount 32 is arranged on the upper lighter portion 10 so that the channeled area 46 in the fuel lever 6 slides about the flint mount 32 when the fuel lever 6 switches between the default and pre-actuation positions.

Figure 5:
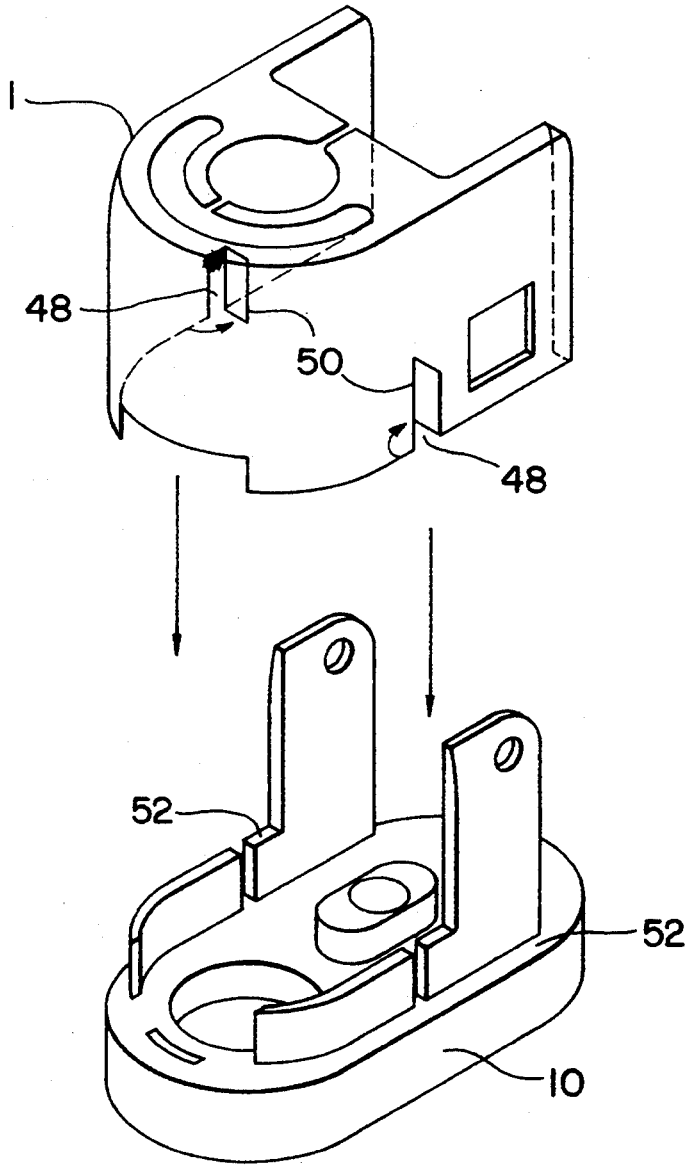
FIG. 5 shows another embodiment of the upper lighter portion and cap in accordance with the invention.

In a further embodiment shown in FIG. 5, the cap portion 1 which partially encloses the upper lighter portion 10 has side portions 48 formed by inward facing flanges 50 defined therein which act as the catch tabs. The inward facing flanges 50 are received by slots 52 defined in the upper lighter portion 10. The upper portions of the inward facing flanges 50 act as catch tabs and may also act as the fulcrum in this embodiment wherein they engage the side flanges 24 of the fuel lever 6 in the pre-actuation position (in the manner of catch tabs 25 from FIG. 1). If the cap 1 is removed from the upper lighter portion 10, there are no catch tabs or fulcrum point, and thus the fuel lever 6 cannot be put into the pre-actuation state and cannot be operated.

The foregoing description of the preferred embodiments of the invention are presented for the purpose of illustrating the invention. This description should not be construed as limiting the invention. For example, other catch tab and flange arrangements or fulcrum arrangements may be provided without departing from the invention. Those skilled in the art will appreciate that various changes and modifications can be made without departing from the spirit and scope of the invention as defined in the appended claims.

What is claimed is:

1. A lighter, comprising:

a fuel compartment defining an open end;

a flame generating portion attached to the fuel compartment, wherein the flame generating portion includes at least one catch tab extending substantially vertically upward and at least one fuel lever stop means;

an actuatable valve means for allowing fuel to be released from the fuel compartment in an area proximate the flame generating portion;

a fuel lever attached to the flame generating portion, wherein the fuel lever includes at least one flange which is adapted to engage with the catch tab of the flame generating portion, said fuel lever further including a finger pad disposed at one end of the fuel lever, the finger pad including an undersurface having a notch defined therein; and means for moving the fuel lever between a default position and a pre-actuation position, wherein in the default position, the fuel lever stop means of the flame generating portion is arranged so as to engage the undersurface of the finger pad at a position away from the notch, and in the pre-actuation position, the fuel lever stop means of the flame generating portion is arranged adjacent the notch in the undersurface of the finger pad such that when the fuel lever is depressed, the fuel lever stop is received in the notch.

2. A lighter as claimed in claim 1, wherein the flame generating portion includes two catch tabs which engage two flanges on the fuel lever.

3. A lighter as claimed in claim 1, wherein the fuel lever includes at least one prong extending from the finger pad.

4. A lighter as claimed in claim 3, wherein the flange extends laterally from the prong.

5. A lighter as claimed in claim 4, further including:

a flint arrangement attached to the flame generating means for generating a spark to ignite gas released via the valve means, the flint arrangement including at least one side wheel and a flint wheel.

6. A lighter as claimed in claim 5, further including a side wheel arresting means extending from a surface of the prong, the side wheel arresting means arranged so as to prevent the side wheel of the flint arrangement from rotating when the lighter is in the default position.

7. A lighter as claimed in claim 5, wherein said flame generating portion includes a cap portion, wherein side portions of said cap portion have inward facing flanges defined therein which act as two catch tabs.

8. A lighter as claimed in claim 1, wherein the fuel lever includes at least two prongs extending from the finger pad such that at least a portion of the actuatable valve means is arranged at a position between the two prongs.

9. A lighter as claimed in claim 8, wherein the fuel lever includes at least two flanges, one flange extending from each prong.

10. A lighter as claimed in claim 9, further including:

a flint arrangement attached to the flame generating means for generating a spark to ignite gas released via the valve means, the flint arrangement including at least one side wheel and a flint wheel.

11. A lighter as claimed in claim 10, further including at least one side wheel arresting means extending from a surface of each prong, the side wheel arresting means arranged so as to prevent the side wheel of the flint arrangement from rotating when the lighter is in the default position.

12. A lighter as claimed in claim 1, further including:

a flint arrangement attached to the flame generating means for generating a spark to ignite gas released via the valve means, the flint arrangement including at least one side wheel and a flint wheel.

13. A lighter as claimed in claim 12, further including a side wheel arresting means extending from the fuel lever, the side wheel arresting means arranged so as to prevent the side wheel of the flint arrangement from rotating when the lighter is in the default position.

14. A disposable child-resistant lighter, comprising:

a fuel compartment defining an open end;

an upper portion sealingly attached to said open end;

said upper portion having a top surface, a front area, a mid-area, and a rear area;

said upper portion including a fuel valve in communication with said fuel compartment, and a lever coupled to said fuel valve;

said upper portion further including two opposing flanges extending from said mid-area;

a flintwheel disposed between said opposing flanges, wherein said flintwheel contacts a flint mounted on a mounting means on said top surface adjacent said flintwheel;

said top surface of said upper portion defining an opening in said front area through which said fuel valve is received, said top surface further including a catch tab projecting upward therefrom, and a lever stop projecting upward from said rear area;

said lever having a front portion corresponding to said front area of said top surface, a middle portion corresponding to the mid-area of said top surface, a rear portion corresponding to the rear area of the top surface, an upper surface, and a bottom surface;

said lever further having lever flanges extending therefrom, said lever being urged rearward and upward by a lever spring mounted between said mounting means and said bottom surface of said rear portion of said lever;

said bottom surface of said lever further having at least one notch defined in said rear portion of said lever, said notch adapted to receive said lever stop of said top surface of said upper portion;

said lever being slidably mounted in a fulcrum arrangement, wherein the lever is adapted to partially slide along a longitudinal axis of said lever between a default position and a pre-actuating position; wherein:

in the default position said lever stop prevents depression of the lever by substantially abutting the bottom surface of said lever in front of said notch, and in the pre-actuation position, the lever is pushed in a forward direction along said longitudinal axis of said lever, compressing said lever spring, wherein said lever flanges engage and are secured by said catch tab such that the notch in the bottom surface of the rear portion of the lever is substantially aligned with the lever stop so as to allow the lever to be depressed to a fuel releasing extent thereby permitting the valve to be actuated and fuel to be released.

15. A disposable child-resistant lighter, comprising:

a fuel containing compartment including side walls, a bottom wall, and an open upper part;

an intermediate lighter portion which is sealably engaged with said fuel containing compartment;

an actuatable valve means having an upper portion extending through a front area of the intermediate portion, the valve means having a lower portion extending into said fuel compartment; and an upper lighter portion attached to the intermediate portion, said upper lighter portion including a lever means, and a top surface, wherein said top surface includes a front area corresponding to the front area of the intermediate portion, a middle area, and a rear area;

said top surface of said upper portion further including two opposing flanges extending from peripheral portions of the middle area, said flanges having mounting means adapted to receive and secure an axle of a flint wheel mounted therebetween, the top surface further having a flint mount located between the opposing flanges, said flint mount securing one end of a flint spring, the other end of the flint spring urging a flint against the flint wheel, said top surface also having a lever stop means extending from said rear area of the top surface;

at least one catch tab extending above said top surface, said catch tab having a front wall substantially perpendicular to said top surface, and a bevelled rear wall;

said lever means of said upper lighter portion having a front portion corresponding to the front area of the top surface, a middle portion corresponding to the middle area of the top surface, and a rear portion corresponding to the rear area of the top surface, an upper surface, a bottom surface, and side surfaces;

said front portion of said lever means including a two prong fork configuration wherein the upper portion of said valve means is disposed between, and engaged by, said prongs, said middle portion of said lever means having at least one side flange extending substantially perpendicular from the side surfaces of said lever means in a spaced relationship with said catch tab, said side flange having a substantially vertical rear wall and a bevelled frontal wall;

said bottom surface of said lever means having a central channel defined therein extending from the middle portion toward the rear portion, said channel partially receiving one end of a lever spring;

said bottom surface of said lever means further having at least one notch defined in the rear portion of said lever means, said notch adapted to receive the lever stop means;

said lever means being slidably mounted in a fulcrum arrangement about said flint mount such that said lever slides in a longitudinal direction between a default position and a pre-actuating position, wherein:

in the default position, the lever stop means prevents depression of the lever means by abutting the bottom surface of said lever means in an area in front, of said notch, and in the pre-actuation position, said lever means is moved in the longitudinal direction of said lever means by compressing the lever spring, wherein the bevelled portion of the side flange of the lever means slides up and over the bevelled portion of the catch tab so as to allow the substantially vertical wall of the catch tab to engage the substantially vertical wall of the side flange and be held thereat by the lever spring, such that the notch in the bottom surface of the rear portion of the lever means is substantially aligned over the lever stop means so as to allow the lever to be depressed to its fuel releasing extent thereby permitting the valve to be actuated in order to release fuel.

16. A lighter as claimed in claim 15, wherein depression of the lever while in the pre-actuation position causes the substantially vertical wall of said catch tab and said side flange to disengage, said lever spring thereafter returning the lever means to the default position.

17. A lighter as claimed in claim 15, wherein the upper lighter portion and the intermediate lighter portion are incorporated into a single unit.

18. A lighter as claimed in claim 15, further including a cap portion partially enclosing said upper lighter portion, wherein side portions of said cap have inward facing flanges defined therein which act as the catch tabs.

19. A lighter as claimed in claim 15, wherein said lever further includes a flintwheel arrest means projecting upward from said upper surface of said lever.

* * * * *